United States Patent [19]

Woo

[11] Patent Number: 4,691,394

[45] Date of Patent: Sep. 8, 1987

[54] COLLAPSIBLE HAMMOCK

[76] Inventor: Chi Goo Woo, 2119 Potspring Rd., Lutherville, Md. 21093

[21] Appl. No.: 943,038

[22] Filed: Dec. 18, 1986

[51] Int. Cl.[4] ..... A45F 3/22; A45F 3/24

[52] U.S. Cl. ..... 5/120; 5/127; 5/129

[58] Field of Search ..... 5/98 B, 98 C, 120, 122, 5/123, 127–129

[56] References Cited

U.S. PATENT DOCUMENTS

| | | | |
|---|---|---|---|
| Re. 7,393 | 11/1876 | Arci | 5/129 |
| 180,729 | 8/1876 | Richardson et al. | 5/128 |
| 313,223 | 5/1885 | Ferguson | 5/128 |
| 320,174 | 6/1885 | Rudd et al. | 5/129 |

FOREIGN PATENT DOCUMENTS

| | | | |
|---|---|---|---|
| 455530 | 3/1950 | Italy | 5/129 |

*Primary Examiner*—Gary C. Smith
*Assistant Examiner*—Michael F. Trettel
*Attorney, Agent, or Firm*—Birch, Stewart, Kolasch & Birch

[57] ABSTRACT

The present disclosure relates to a collapsible hammock which comprises light weight support members and a tensile strength wire member for preventing the light weight support members from inwardly bending whereby the hammock is convenient and easy to use and carry, and easy and simple to assemble and manufacture.

9 Claims, 4 Drawing Figures

COLLAPSIBLE HAMMOCK

BACKGROUND OF THE INVENTION

The present invention relates to a collapsible hammock for use in the outdoors, such as in the park or in the yard, and also for use indoors. More particularly, the present invention relates to a hammock swing made of netting, and supported by light pipe support members and tensile strength wire, and structured with collapsible members.

Swinging beds or hammocks are known which are adapted to be attached to trees or poles. However, there are many problems with the prior art hammocks, for example, it is difficult to connect the hammock between adjacent trees. Also, many types of hammocks having support members which provide support from the ground are well known in the art. However, it is very difficult to handle such hammocks because the support members which are made of steel have a very heavy weight.

OBJECTS AND SUMMARY OF THE INVENTION

Accordingly, it is an object of the present invention to provide an improved, collapsible hammock.

Another object of the present invention is to provide a swinging hammock or bed which is provided with light weight support members such as pipes and a bed made of netting.

Still another object of the present invention is to provide a hammock with additional support members, that is, with tensile strength wire for preventing the pipe support members for bending inwardly.

Another object of the present invention is to provide a collapsible hammock including pipe support members which are positioned on a land surface or on a ground floor.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

The present invention relates to a collapsible hammock which comprises light weight support members and tensile strength wire members for preventing the light weight support members from inwardly bending whereby the hammock is convenient and easy to use and carry, and easy and simple to assemble and manufacture.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
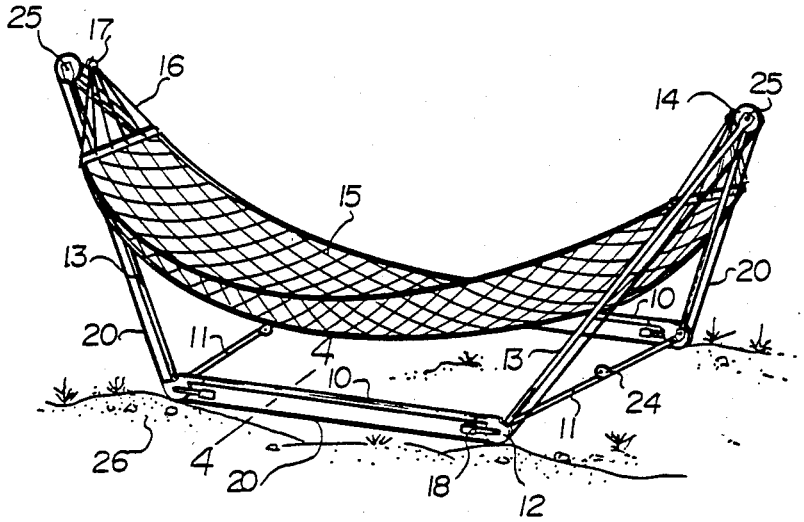
FIG. 1 is a perspective view of the improved collapsible hammock of the present invention.

Referring now in detail to the drawings for the purpose of illustrating the present invention, an improved collapsible hammock as shown in FIG. 1 comprises main, laterally disposed support pipes 10, cross support members 11 and vertically disposed, auxiliary support pipes 13 which are connected to the main support members 10 through hinge members 12, respectively. A tensile strength wire member 20 passes through the hinge members 12 and connecting members 14 attached to the auxiliary support pipes 13, through connecting pins 25, to support a netting bed 15 which is mounted to the connecting member 14.

The ends of the main support pipe members 10 are connected at their ends to cross support members 11 to form a rectangular shaped configuration which stands on a land surface 26 or a ground floor. The cross support member 11 can be folded upwardly by folding members 24 to provide a compact assembly.

Figure 2:
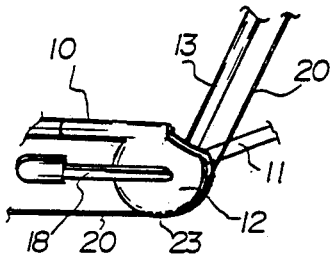
FIG. 2 is an enlarged perspective view showing a hinge member of the collapsible hammock of the present invention.

As shown in FIG. 2, the hinge member 12 is provided with an adjusting arm member 18 which controls the amount of angle between the main support member 10 and the auxiliary support member 13. Accordingly, the auxiliary support members 13 can be folded inwardly, toward each other, for a compact assembly. Also, the hinge member 12 contains an aperture 23 for passing through the tensile strength wire member 20 therethrough.

Figure 3:
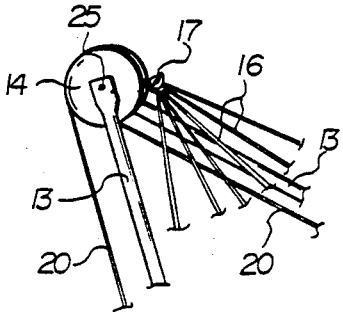
FIG. 3 is an enlarged perspective view showing a connecting member of the collapsible hammock of the present invention.

As shown in FIG. 3, the connecting member 14 is fixed to the tensile strength wire member 20 thereto and includes a ring hanger 17 which engages a plurality of ropes 16 on the netting bed 15.

Figure 4:
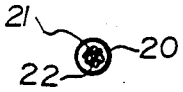
FIG. 4 is a cross-section view of a tensile strength wire used in the present invention, taken along line 4—4 as shown in FIG. 1.

The tensile strength wire member 20 comprises a steel thread 22 covered with a plastic material 21 such as polyvinylchloride (FIG. 4). Accordingly, the wire member 20 substantially prevents the main and auxiliary support pipes 10 and 13 from bending inwardly when the netting bed 15 is utilized. The main and auxiliary support pipes 10 and 13 and folding support members 11 are made of light weight metals, such as aluminum based alloys, so that the collapsible hammock of the present invention is light and easy to carry.

The collapsible hammock of the present invention is a very useful device which is easy to assemble, handy to carry and use in the outdoors or indoors, and simple to manufacture.

The invention being thus described, it will be obvious that the same may be varied in many ways. Such variations are not to be regarded as a departure form the spirit and scope of the invention, and all such modifications as would be obvious to one skilled in the art are intended to be included in the scope of the following claims.

What is claimed is:

1. A collapsible hammock comprising:

main laterally disposed support members and cross support members, said main laterally disposed support members being connected to said cross support members to form a supporting base, a pair of vertically disposed, auxiliary support members extending from each end of said supporting base, one end of each said auxiliary support member being connected to said supporting base by first hinge members, with the other ends thereof being connected together by second hinge members, a tensile strength wire member passing through said lateral support members with said hinge members connected therewith, and a bed member suspended between said vertically disposed auxiliary support members, said bed member being supported at each end by said tensile member attached thereto.

2. The collapsible hammock of claim 1 wherein the cross support members are provided with a folding member for folding the cross support members inwardly.

3. The collapsible hammock of claim 1 wherein the main and auxiliary support members and the cross support member are made of light metals.

4. The collapsible hammock of claim 3 wherein the light metals are an aluminum based alloy.

5. The collapsible hammock of claim 1 wherein the first hinge member is provided with an adjusting member for controlling the angle between the main and auxiliary support members.

6. The collapsible hammock of claim 1 wherein the tensile strength wire comprises a steel thread provided with a cover member.

7. The collapsible hammock of claim 6 wherein the cover member is made of a plastic material.

8. The collapsible hammock of claim 7 wherein the plastic material is polyvinylchloride.

9. The collapsible hammock of claim 1 wherein the lateral support members are connected to the cross support member to from a supporting base with a rectangular configuration, and the auxiliary support members are connected to each end of the supporting base to form triangular configurations.

* * * * *